US010947963B2

(12) United States Patent
Dyminski

(10) Patent No.: US 10,947,963 B2
(45) Date of Patent: Mar. 16, 2021

(54) HYDRAULIC PUMP WITH INLET BAFFLE

(71) Applicants: Parker-Hannifin Corporation, Cleveland, OH (US); Daniel Dyminski, Portage, MI (US)

(72) Inventor: Daniel Dyminski, Portage, MI (US)

(73) Assignee: Parker-Hannifin Corporation, Cleveland, OH (US)

( * ) Notice: Subject to any disclaimer, the term of this patent is extended or adjusted under 35 U.S.C. 154(b) by 200 days.

(21) Appl. No.: 16/086,100

(22) PCT Filed: Jun. 16, 2017

(86) PCT No.: PCT/US2017/036042

§ 371 (c)(1),
(2) Date: Sep. 18, 2018

(87) PCT Pub. No.: WO2017/222799

PCT Pub. Date: Dec. 28, 2017

(65) Prior Publication Data

US 2019/0390663 A1 Dec. 26, 2019

Related U.S. Application Data

(60) Provisional application No. 62/346,137, filed on Jun. 6, 2016.

(51) Int. Cl.
*F04B 1/2021* (2020.01)
*F04B 1/2064* (2020.01)
(Continued)

(52) U.S. Cl.
CPC ..... *F04B 1/2021* (2013.01); *F04B 1/2064* (2013.01); *F04B 1/2035* (2013.01);
(Continued)

(58) Field of Classification Search
CPC ..... F04B 1/0452; F04B 1/0465; F04B 1/10; F04B 1/12; F04B 1/122; F04B 1/2042;
(Continued)

(56) References Cited

U.S. PATENT DOCUMENTS

| | | | | |
|---|---|---|---|---|
| 6,406,271 | B1 * | 6/2002 | Valentin | F04B 1/126 417/269 |
| 2014/0328702 | A1 * | 11/2014 | Riediger | F04B 1/126 417/269 |
| 2016/0108901 | A1 * | 4/2016 | Kronpass | F04B 1/124 417/269 |

FOREIGN PATENT DOCUMENTS

| | | |
|---|---|---|
| DE | 102010006895 | 8/2011 |
| EP | 0255034 | 2/1988 |
| FR | 3000770 | 7/2014 |

OTHER PUBLICATIONS

International Search Report and Written Opinion of PCT/US2017/036042 dated Oct. 16, 2017.

* cited by examiner

*Primary Examiner* — Charles G Freay
*Assistant Examiner* — Chirag Jariwala
(74) *Attorney, Agent, or Firm* — Renner, Otto, Boisselle & Sklar, LLP

(57) ABSTRACT

An inlet baffle chamber (40) is provided in the port cover (26) of a piston pump. The inlet baffle chamber (26) fluidly connects a compressed piston chamber to an adjacent lower pressure piston chamber while the lower pressure piston chamber is in the suction cycle and separately receiving fluid from an inlet manifold (38) of the port cover (26). Instead of de-compressing high pressure fluid directly to pump's inlet (36) as in prior art pumps, the inlet baffle chamber (40) directs fluid to the next piston that is already in the suction cycle.

12 Claims, 11 Drawing Sheets

(51) Int. Cl.

| | |
|---|---|
| *F04B 1/2035* | (2020.01) |
| *F04B 1/2042* | (2020.01) |
| *F04B 1/324* | (2020.01) |
| *F04B 11/00* | (2006.01) |

(52) U.S. Cl.
CPC ..... *F04B 1/2042* (2013.01); *F04B 1/324* (2013.01); *F04B 11/0091* (2013.01)

(58) Field of Classification Search
CPC ..... F04B 1/2021; F04B 1/22; F04B 1/303; F04B 1/34; F04B 7/0019; F04B 7/0023; F04B 7/0038; F04B 7/0042; F04B 7/0046; F04B 11/0091
USPC ..... 91/499; 417/269
See application file for complete search history.

HYDRAULIC PUMP WITH INLET BAFFLE

RELATED APPLICATION DATA

This application is a national stage application pursuant to 35 U.S.C. § 371 of PCT/US2017/036042 filed on Jun. 16, 2017, which claims the benefit of U.S. Provisional Application No. 62/346,137 filed Jun. 6, 2016, the contents of which are incorporated herein by reference.

TECHNICAL FIELD

The present invention relates generally to hydrostatic pumps, and more particularly to a baffle for an inlet manifold configuration for use in such hydrostatic pumps.

BACKGROUND

Hydrostatic pumps convert the mechanical energy transmitted by a prime mover into hydraulic energy through the pumping of hydraulic fluid. A common type of hydrostatic or hydraulic pump is an axial piston-type pump including a plurality of reciprocating pistons housed within a rotating pump barrel, and which are in fluid communication through hydraulic porting with system components or actuators. Rotation of the hydraulic pump barrel relative to a moveable swash plate creates an axial motion of the pump pistons that forces hydraulic fluid through the hydraulic porting to the other system components.

In operation of the pump, the maximum speed at which the barrel chambers fill completely with working fluid under atmospheric pressure is called self-priming speed. It is a very important parameter which has an impact on performance of the pump. Higher self-priming speed means: more efficient pump operation at higher speed; more efficient pump operation at lower inlet pressure (e.g. high elevations); better reliability (higher self-priming speed leads to better inlet conditions at lower speed which can prevent cavitation damage); and more output power which is linear relationship to output flow (speed).

An issue adversely related to pump operation involves the transition that takes place when a pump piston passes from the high pressure pumping phase into the low pressure suction phase. Such transition is called de-compression. In a standard pump design during de-compression, high pressure fluid is released into the pump's inlet manifold which happens very rapidly and causes flow disturbance. It is due to the fact that fluid during de-compression has very high velocity and its direction is always against/opposite the suction flow direction. This result is depicted in FIG. 2 which shows a standard prior art pump's internal fluid volume 2. Arrows R indicate the de-compression flow direction, arrows B indicate the suction flow direction. It is evident that flow direction during de-compression of the pressurized piston chamber 4 into the inlet manifold 6 will disrupt fluid flow in the inlet manifold causing a reduction in the amount fluid that can flow into the suction piston chamber 8. The fluids in the inlet manifold 6 moving in different directions induces aeration and creates a higher inlet pressure ripple which can increase noise levels. One prior art solution is to obtain de-compression into the pump casing, however this causes increased case-flow and case-pressure which has negative impact on external seals and pump efficiency. This solution also doesn't take advantage of de-compression flow being added to the next piston in a suction cycle. A second solution is widely used in the prior art and is called the ripple chamber design (see U.S. Pat. No. 5,247,869 Palmberg et al.) which is also shown in FIG. 2 generally at 7. However, as shown, a ripple chamber 7 is a separate enclosed volume not connected to inlet or outlet port (only to the piston), are utilized on pre-compression (opposite side of the port plate) and for high pressure outlet port ripples and noise reduction primarily. A more desirable solution would be the one that does not impact weight, increase the pump envelope or increase cost—or that can be used in combination with a ripple chamber.

SUMMARY

At least one advantage over the prior art is provided by a pump assembly comprising: a piston rotating group including a pump barrel defining a plurality of bores, and a plurality of moveable pistons that are received in the plurality of bores of the pump barrel; an input shaft for driving rotation of the piston rotating group; wherein as the piston rotating group rotates, the pistons extend and contract to drive fluid into and out from the pump assembly; a port plate having an inlet fluid passage, an outlet fluid passage, and a decompression port; a port cover including a baffle chamber and an inlet manifold; the piston rotating group having a position in which a compressed piston bore is fluidly connected to the decompression port of the port plate, the decompression port is fluidly connected to the baffle chamber of the port cover, the baffle chamber is fluidly connected to the inlet port of the port plate, and the inlet port of the port plate is fluidly connected to a low pressure piston bore adjacent to the first compressed piston bore, the low pressure piston bore also being fluidly connected to the inlet manifold.

At least one advantage over the prior art is provided by a pump assembly comprising: a piston rotating group including a pump barrel defining a plurality of bores, and a plurality of moveable pistons that are received in the plurality of bores of the pump barrel; an input shaft for driving rotation of the piston rotating group; wherein as the piston rotating group rotates, the pistons extend and contract to drive fluid into and out from the pump assembly; a port cover including an inlet manifold and a baffle chamber; the piston rotating group having a position where a compressed piston chamber is fluidly connected to an adjacent low pressure piston chamber by the baffle chamber while the low pressure piston chamber is fluidly connected to the inlet manifold.

At least one advantage over the prior art is provided by a method of operating a pump assembly having a piston rotating group including a pump barrel defining a plurality of bores, and a plurality of moveable pistons that are received in the plurality of bores of the pump barrel; the method comprising the step of: rotating the piston rotating group to a position where a baffle chamber fluidly connects a compressed piston chamber to an adjacent lower pressure piston chamber while the at the same time fluid from the inlet manifold is directed into the lower pressure piston chamber.

BRIEF DESCRIPTION OF THE DRAWINGS

An embodiment of this invention will now be described in further detail with reference to the accompanying drawings, in which.

DETAILED DESCRIPTION OF THE DRAWINGS

Figure 1:
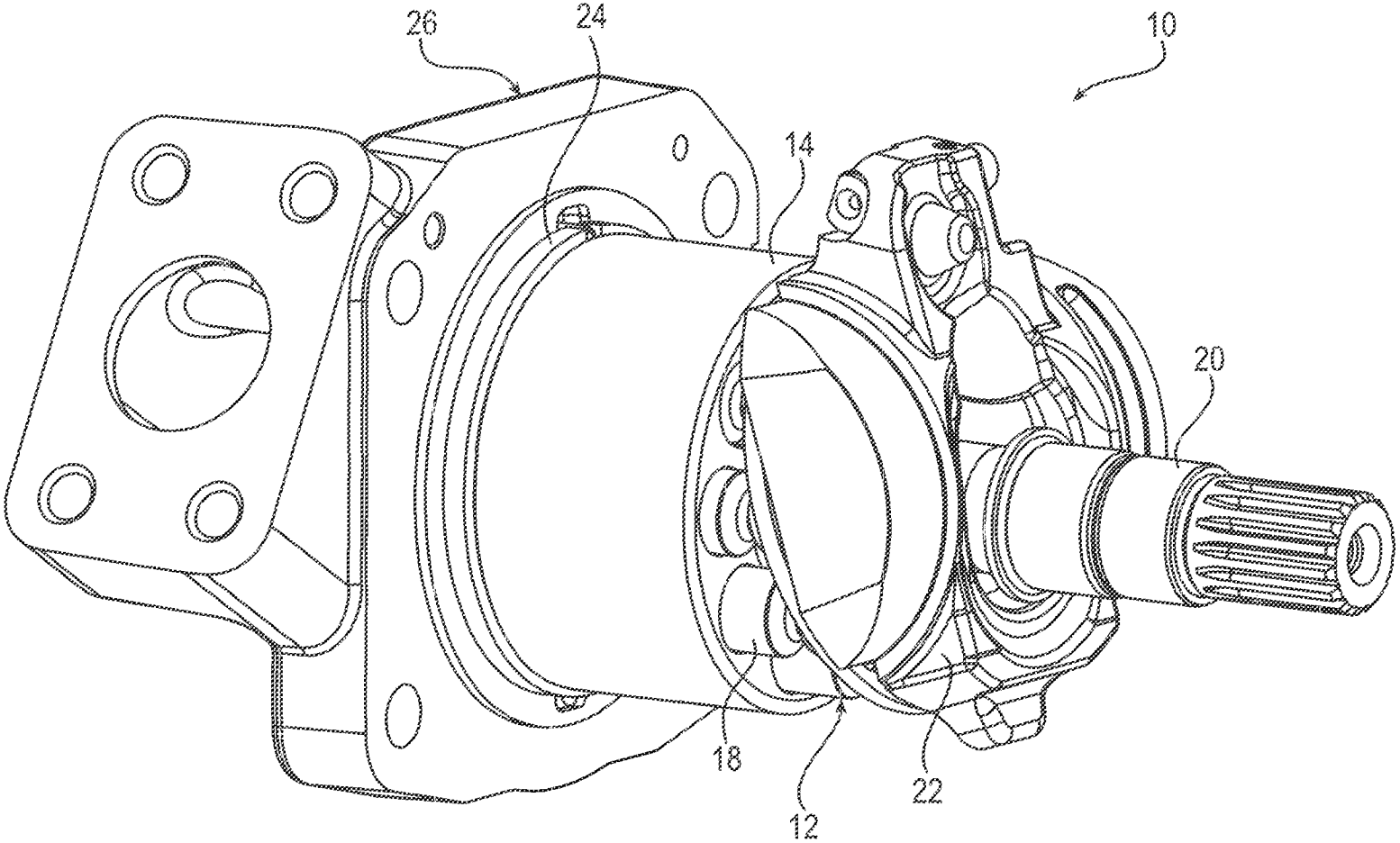
FIG. 1 shows a perspective view of a portion of a pump assembly in accordance with an embodiment of the invention.

Referring now to FIG. 1 a portion of a pump assembly of the present invention is shown in accordance with an embodiment of the invention. The pump assembly 10 comprises a piston rotating group 12 including a pump barrel 14 defining a plurality of bores 16, and a plurality of moveable pistons 18 that are received in the plurality of bores of the pump barrel. The pump assembly 10 further comprises an input shaft 20 for driving rotation of the piston rotating group 12 against a moveable swashplate 22. While a swashplate 22 is depicted for the variable displacement axial piston pump shown, the invention could also be applied to fixed displacement axial piston pumps of swashplate design, as well as axial piston pumps of bent-axis design (both fixed and variable displacement). As the piston rotating group 12 rotates against a port plate 24, the pistons 18 extend and contract to drive fluid into and out from the pump assembly 10 through the port cover 26.

Figure 3:
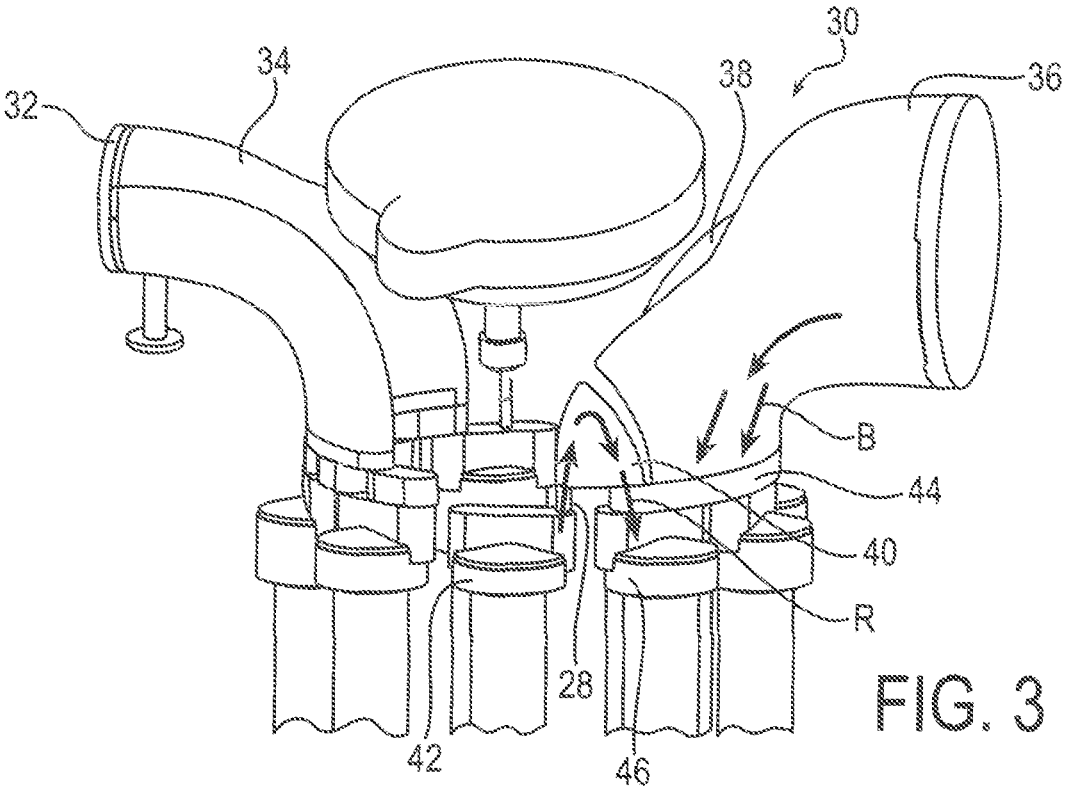
FIG. 3 shows a partial perspective view of the internal fluid volume of a pump assembly in accordance with an embodiment of the invention depicting fluid flow.

The internal fluid volume 30 of the pump assembly 10 is shown in FIG. 3. The internal volume of the port cover 26 includes an outlet port 32 fluidly connected to an outlet manifold 34 and an inlet port 36 fluidly connected to an inlet manifold 38. The port cover 26 further includes a baffle chamber 40 which re-directs pressurized fluid from a compressed piston 42 and through a decompression port 28 of the port plate 24 back through an inlet fluid passage 44 of the port plate 24 as depicted by the arrows R and into the next piston cylinder 46 that is already in the suction cycle. The pressurized fluid does not interfere with the fluid entering the inlet manifold 38 as depicted by arrows B allowing the flow to stay more uniform and undisrupted. The baffle chamber 40 may be a leading portion of the inlet manifold 38 that is walled off from the rest of the inlet manifold or it can be a separate chamber from the inlet manifold. The term "leading" means that as the compressed pistons rotate toward the inlet manifold and the suction pistons move away from the inlet manifold, the leading side of the inlet manifold is the portion that first encounters the compressed pistons and the trailing side is the side opposite the leading side. It is noted that the decompression port 28 is used only for decompression of the piston chambers effectively making it a one way port in contrast to a port utilized for a ripple chamber that is used to charge and discharge the ripple chamber.

Figure 4:
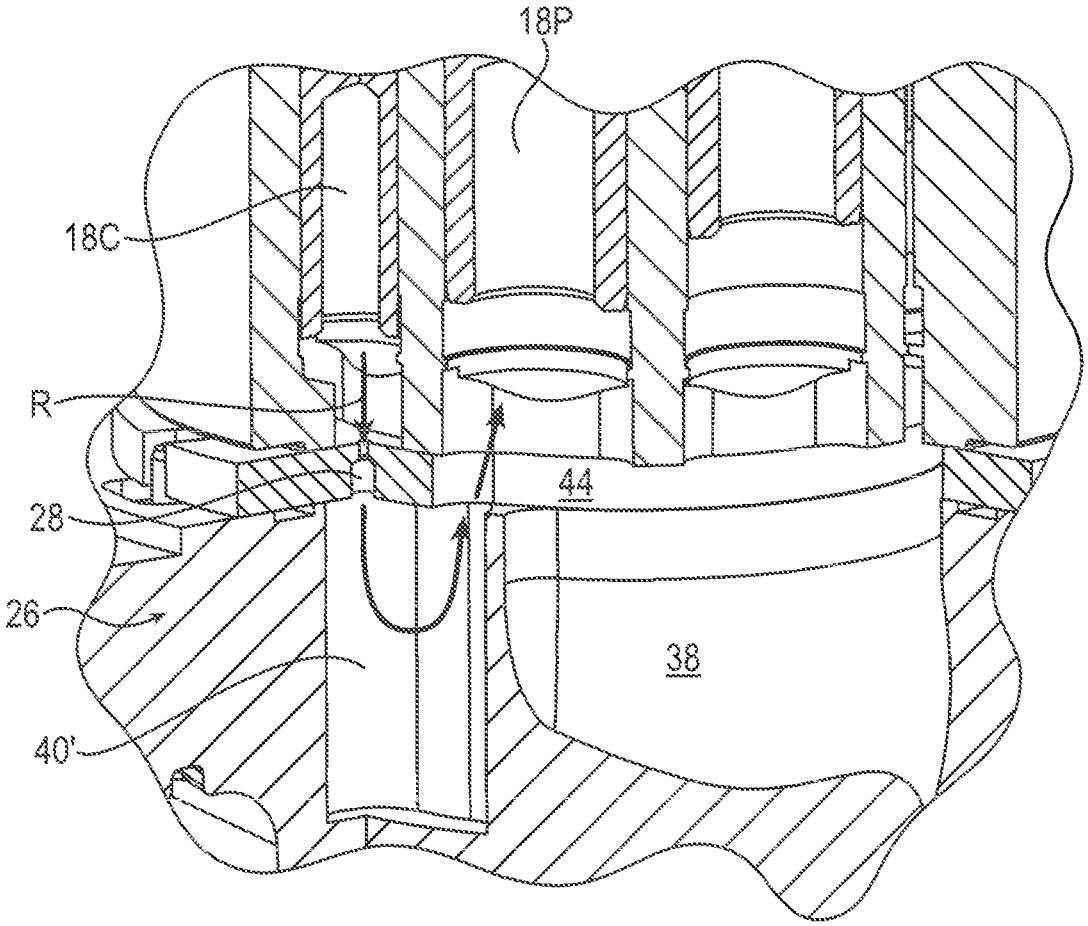
FIG. 4 shows a partial sectional view of a portion of the pump assembly of another embodiment of the invention.
Figure 5:
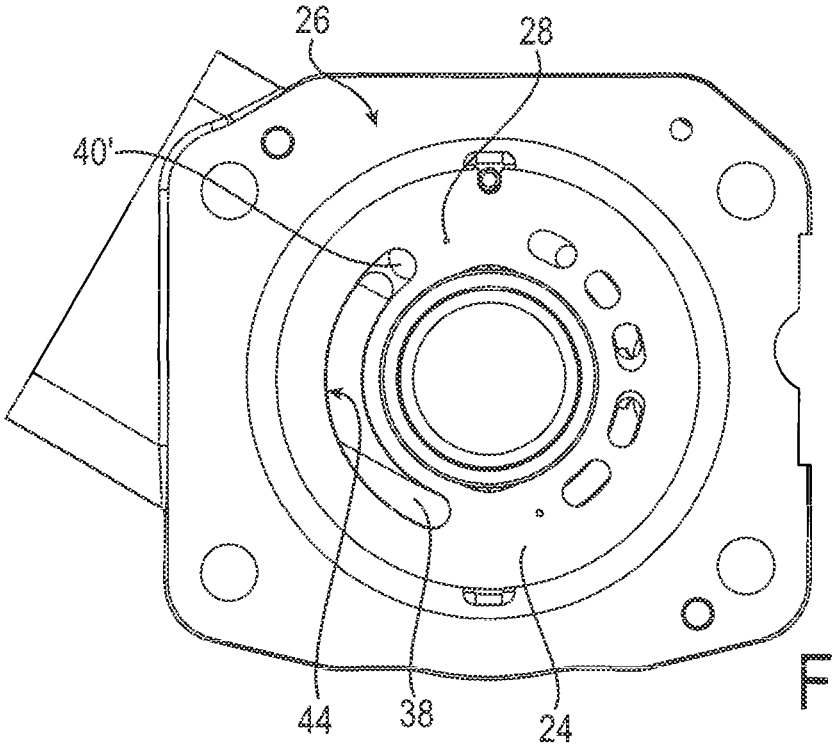
FIG. 5 shows a top elevational view of the port cover and port plate of the pump assembly shown in FIG. 4.
Figure 6:
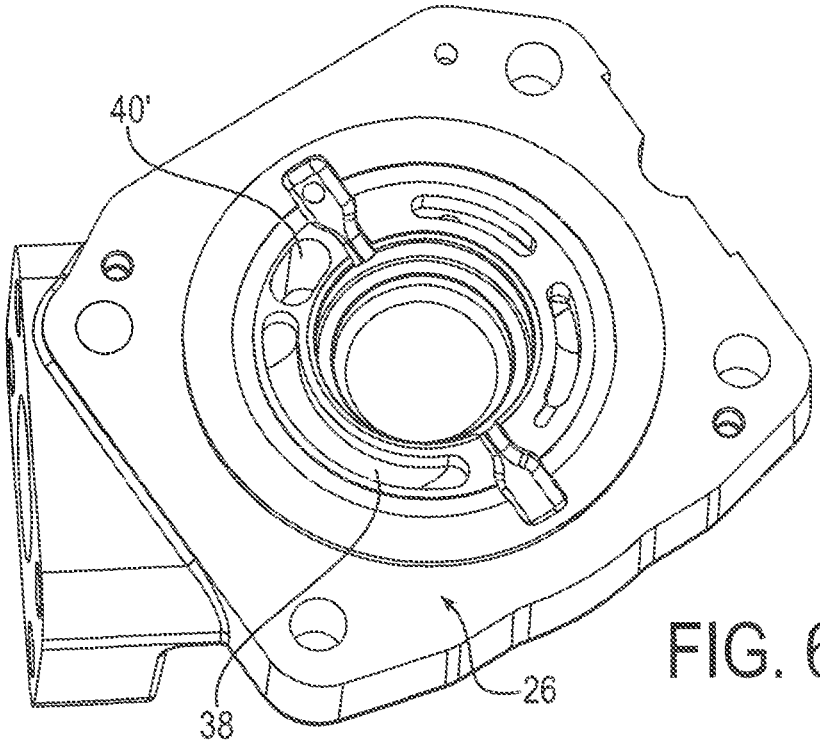
FIG. 6 shows a perspective top view of the port cover shown in FIG. 5 with the port plate removed.

Referring to FIGS. 4, 5, and 6, another embodiment of the invention is shown as the baffle chamber 40' is formed by machining into the port cover 26 or casting the baffle chamber into the port cover 26. In this embodiment, pressurized fluid R from compressed piston 18C flows through decompression outlet 28 formed through port plate 26. The fluid flows into baffle chamber 40' and is redirected through the inlet fluid passage 44 of the port plate 26 and into the sucking piston 18P.

Figure 7:
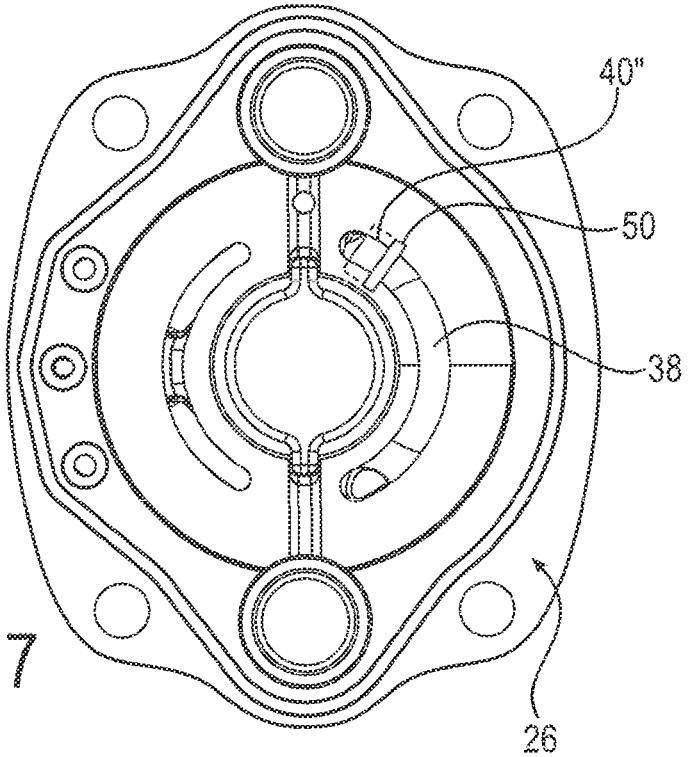
FIG. 7 shows a top view of a port cover in accordance with another embodiment of the present invention.
Figure 8:
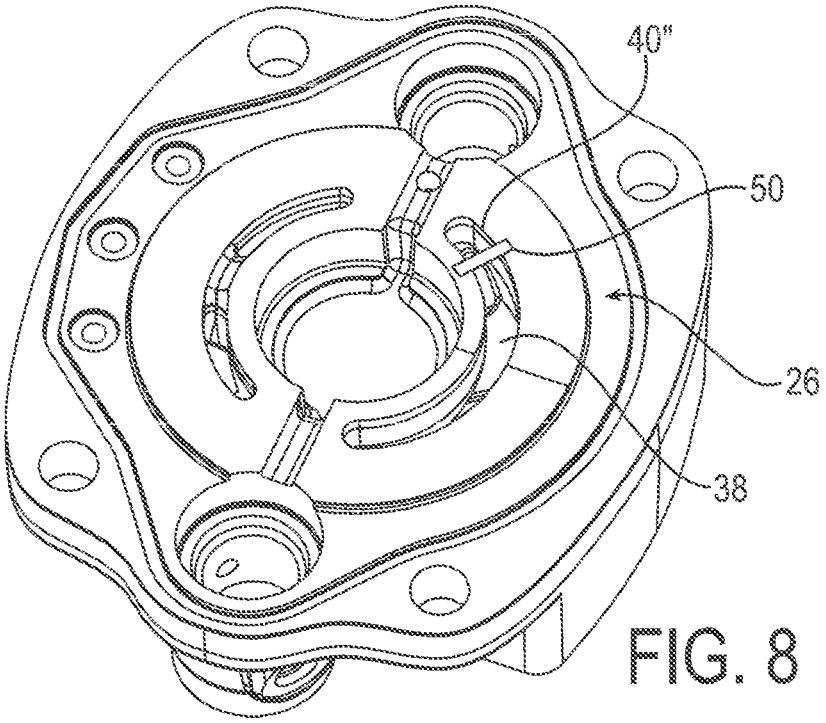
FIG. 8 shows a perspective view of a port cover showing the embodiment shown in FIG. 7.
Figure 9:
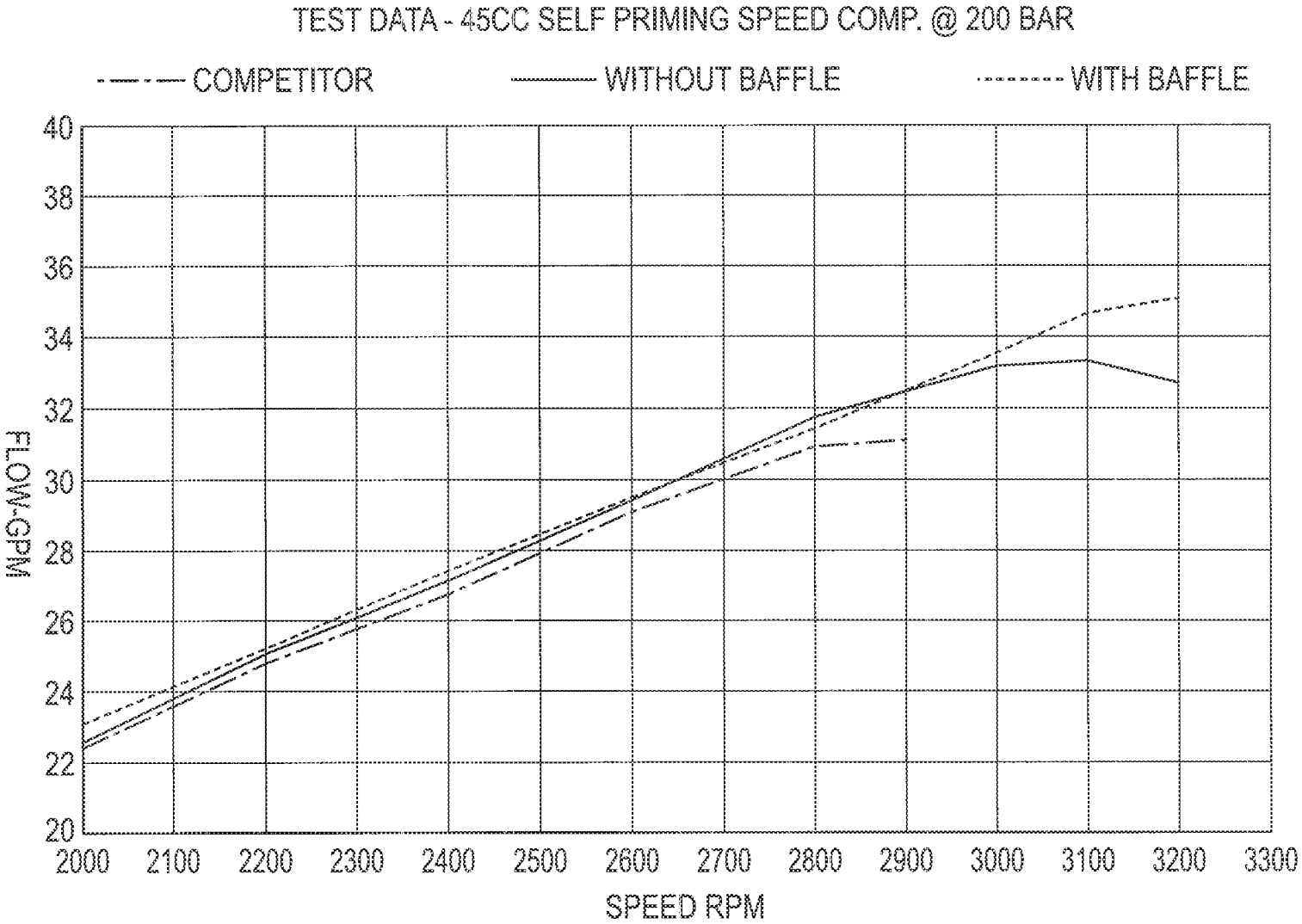
FIG. 9 shows a graph depicting a pump self-priming test comparison.
Figure 10:
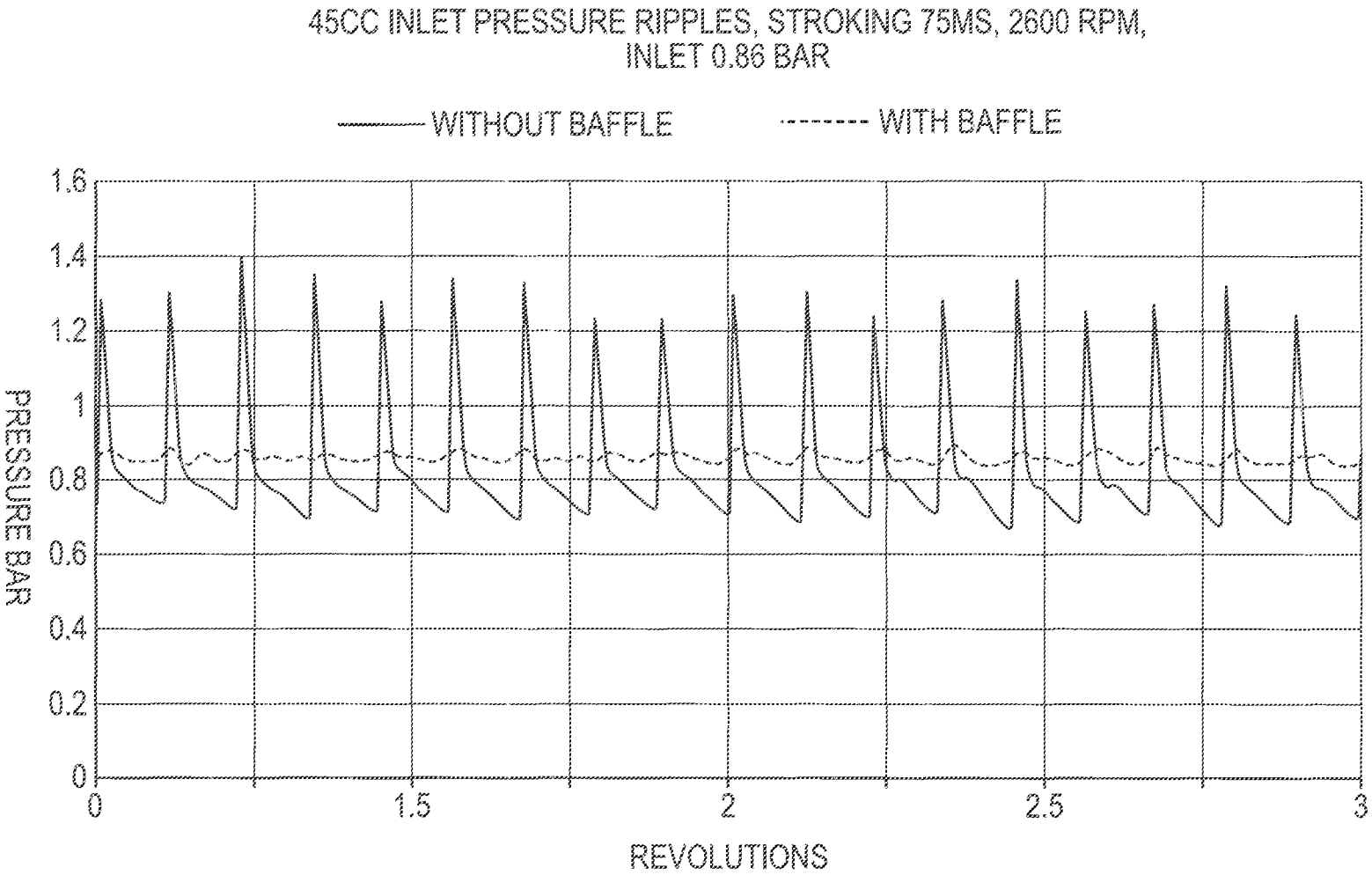
FIG. 10 shows a graph depicting a pump inlet pressure test comparison.
Figure 11:
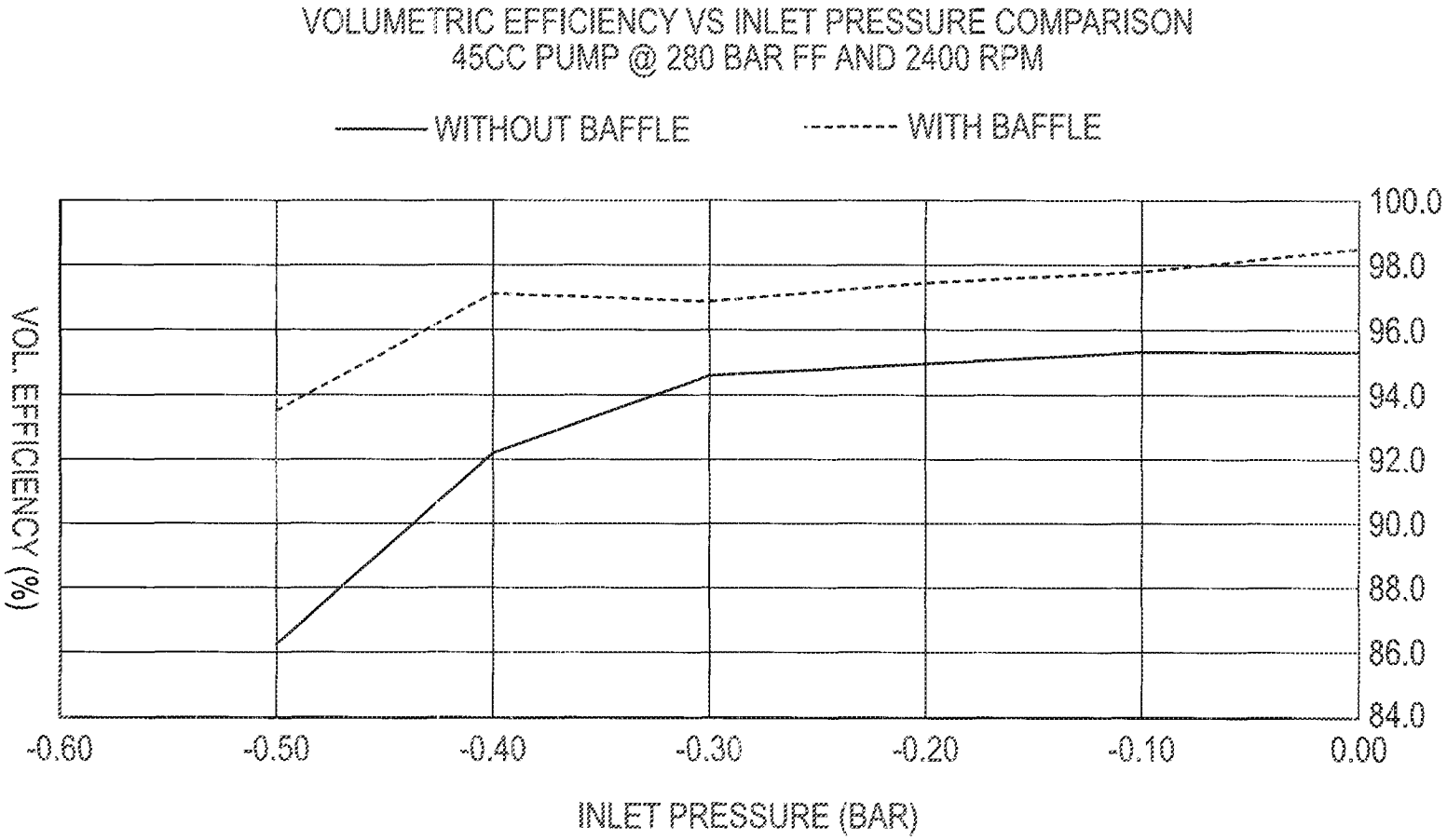
FIG. 11 shows a graph depicting pump volumetric efficiency comparison at the pump cover inlet.
Figure 12:
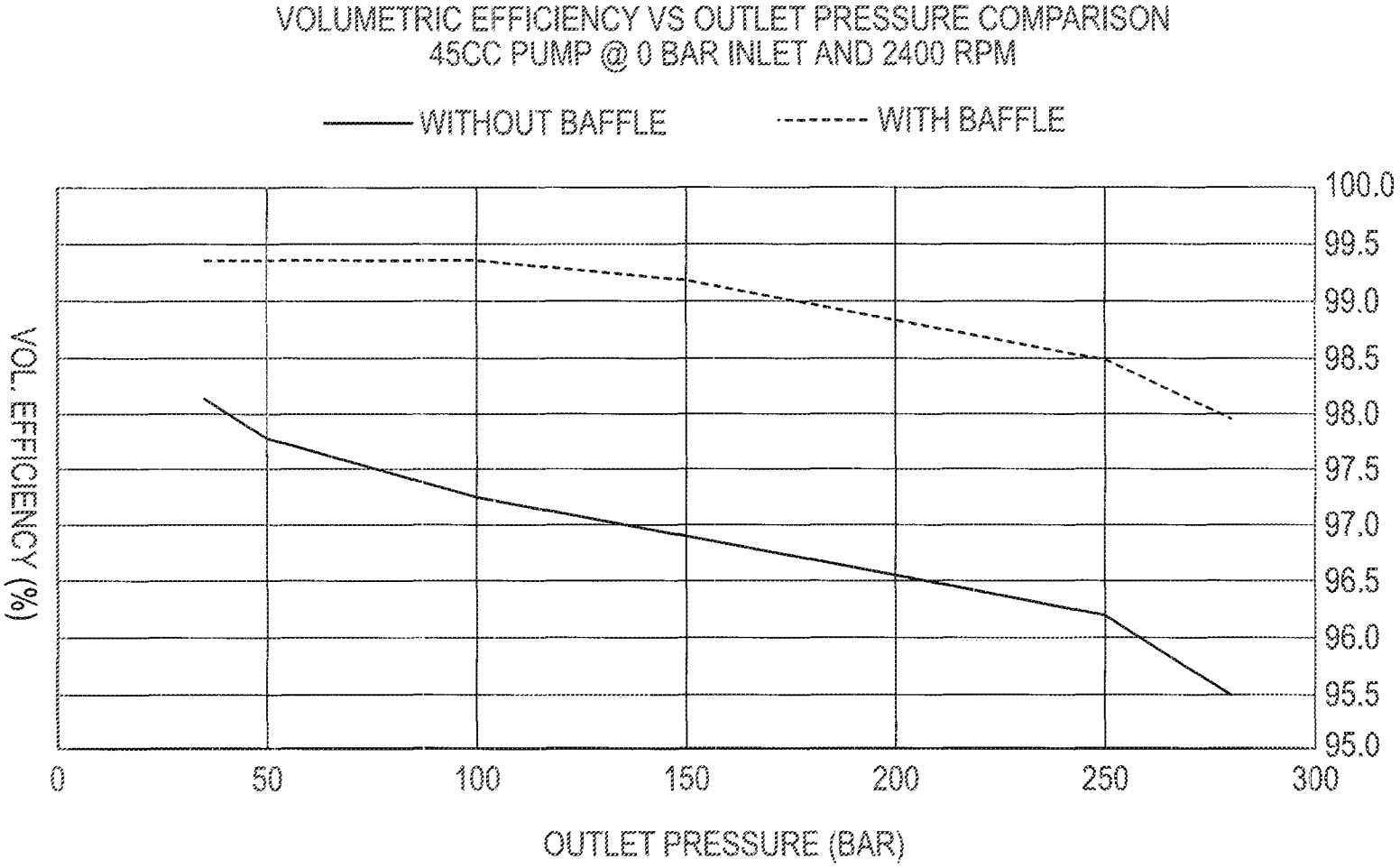
FIG. 12 shows a graph depicting pump volumetric efficiency comparison at the pump cover outlet.

Referring to FIGS. 7 and 8, another embodiment of the invention is shown as the baffle chamber 40" is formed by a baffle plate 50 positioned transversely across the inlet manifold 38. In this manner, the baffle chamber would be similar to the baffle chamber 40 shown in FIG. 3 with the baffle plate 50 essentially walling off a portion of the inlet manifold 38 to create the baffle chamber 40".

Figure 13:
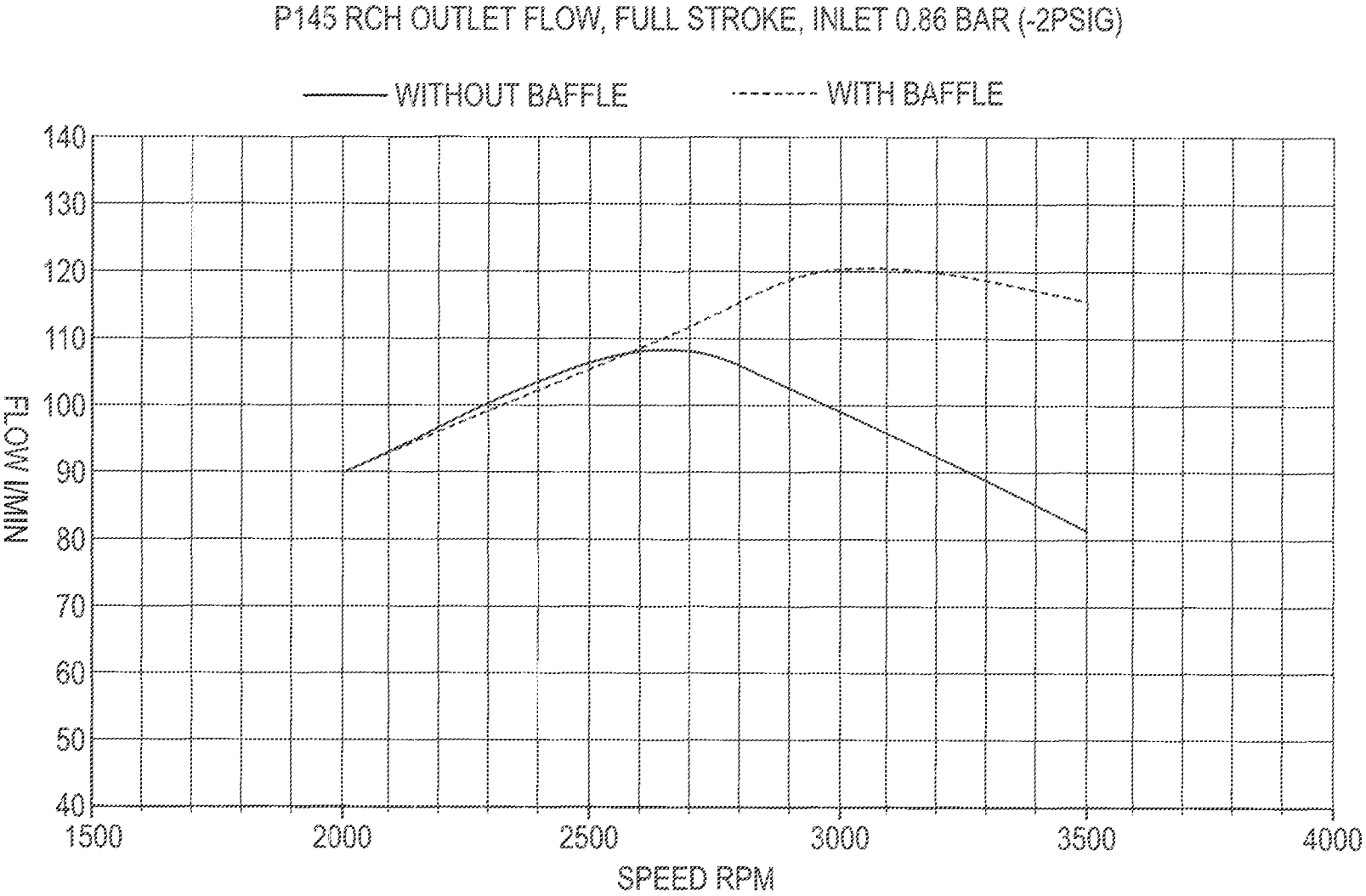
FIG. 13 shows a graph depicting pump flow comparison at the pump outlet.

Referring to FIGS. 9-13, various performance tests were conducted on a prior art pump and a pump incorporating a baffle chamber in accordance with an embodiment of the present invention. The pump assembly 10 showed significant improvement over the prior art pump in a self-priming test (FIG. 9), a pump inlet pressure test (FIG. 10) a volumetric efficiency test at the pump cover inlet (FIG. 11) a volumetric efficiency test at the pump cover outlet (FIG. 12), and a pump flow test at the pump outlet (FIG. 13).

Figure 2:
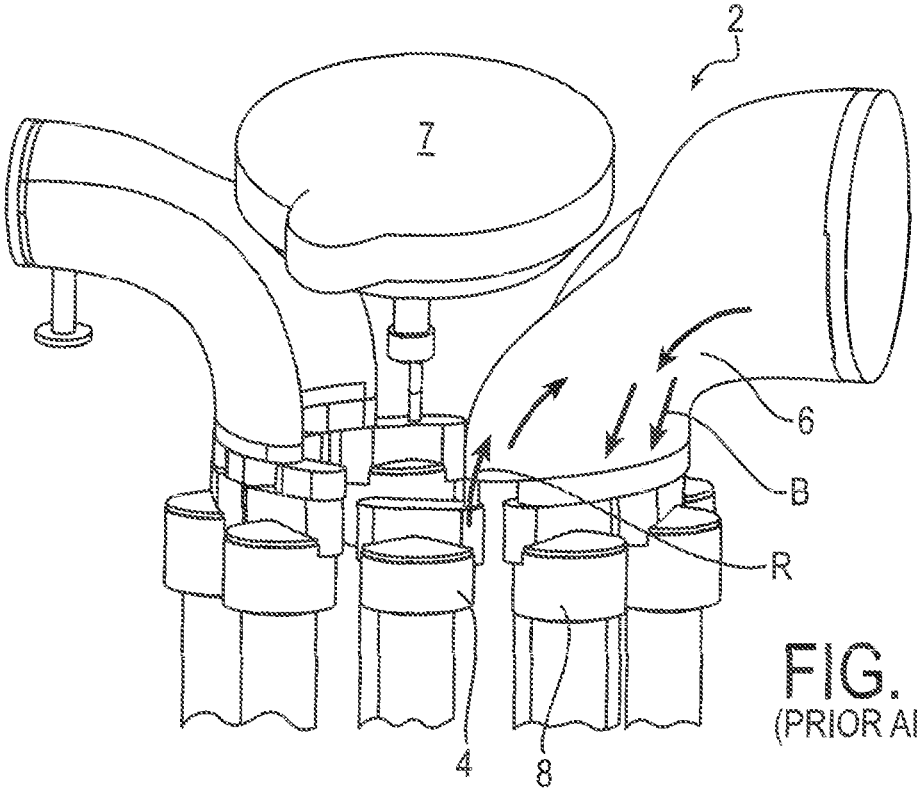
FIG. 2 (PRIOR ART)
FIG. 2 shows a partial perspective view of the internal fluid volume of a prior art pump assembly depicting fluid flow.
Figure 14:
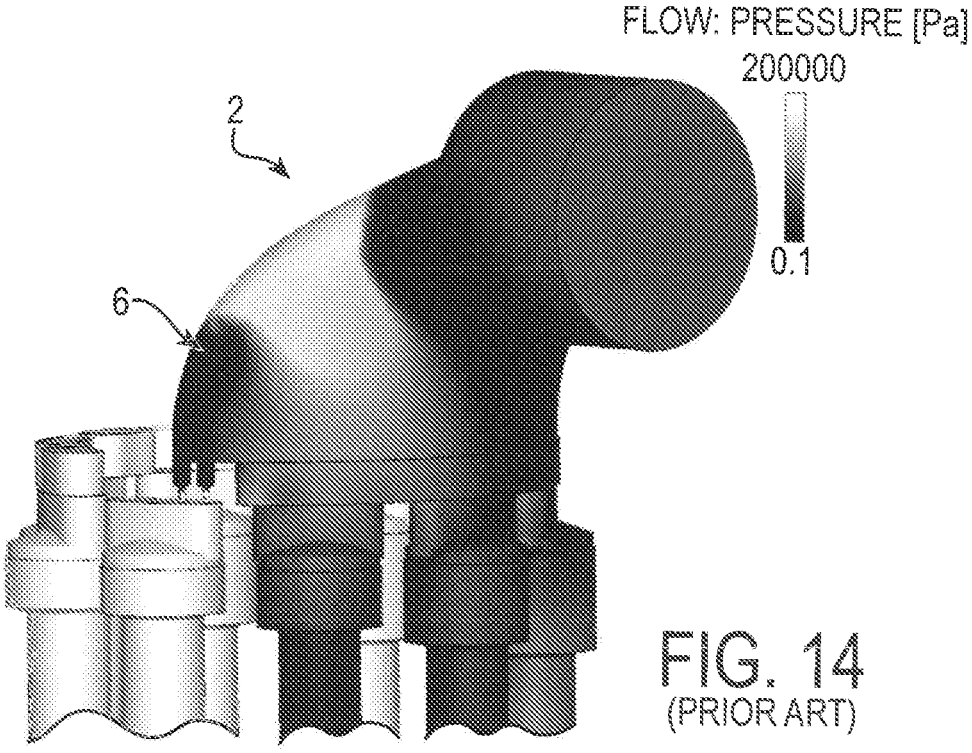
FIG. 14 (PRIOR ART)
FIG. 14 shows a pressure distribution within the internal fluid volume of a prior art pump.
Figure 15:
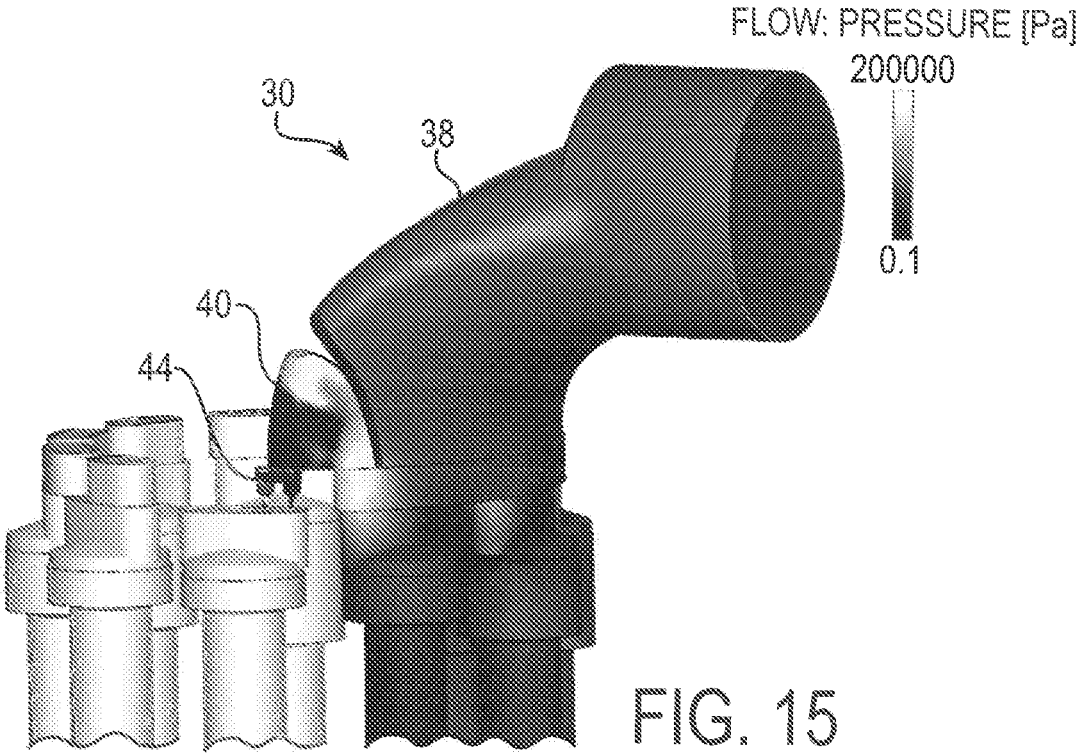
FIG. 15 shows a pressure distribution within the internal fluid volume of a pump in accordance the embodiment shown in FIG. 3.

Referring to FIGS. 14 and 15, a computer simulation was conducted to show the differences in pressure within the inlet manifold of a prior art pump and of a pump in accordance with an embodiment of the invention. The internal fluid volume 2 of prior art pump (FIG. 14) shows significant high pressure in the inlet manifold 6 generally at the location of intersection of the decompression flow and inlet flow as shown in FIG. 2. The internal fluid volume 30 of the pump shown in FIG. 15 corresponds to the embodiment shown in FIG. 3 and shows that the pressure in the inlet manifold 38 is significantly lower and evenly distributed while the high pressure is limited to the baffle chamber 40. Two decompression ports 44 are also shown.

The present invention improves pump inlet manifold by taking advantage of transition that takes place when a pump piston passes from the high pressure pumping phase into the low pressure suction phase. The proposed baffle concept eliminates flow disruption and reduces problems associated with de-compression. This is done by re-routing de-compression flow. Instead of de-compressing high pressure fluid directly to pump's inlet, the baffle directs fluid to the next piston that is already in the suction cycle.

The invention claimed is:

1. A pump assembly comprising:

a piston rotating group including a pump barrel defining a plurality of bores, and a plurality of moveable pistons that are received in the plurality of bores of the pump barrel;

an input shaft for driving rotation of the piston rotating group;

wherein as the piston rotating group rotates, the pistons extend and contract to drive fluid into and out from the pump assembly;

a port plate having an inlet fluid passage, an outlet fluid passage, and a decompression port; and a port cover including a baffle chamber and an inlet manifold;

the piston rotating group being configured such that during operation the piston rotating group provides a position in which a fluid from a compressed piston bore flows through the decompression port to the baffle chamber of the port cover, and from the baffle chamber through the inlet fluid passage of the port plate, and into a low pressure piston bore adjacent to the first compressed piston bore while the low pressure piston bore is fluidly connected to the inlet manifold.

2. A pump assembly comprising:

a piston rotating group including a pump barrel defining a plurality of bores, and a plurality of moveable pistons that are received in the plurality of bores of the pump barrel;

an input shaft for driving rotation of the piston rotating group;

wherein as the piston rotating group rotates, the pistons extend and contract to drive fluid into and out from the pump assembly;

a port plate having an inlet fluid passage, an outlet fluid passage, and a decompression port;

a port cover including a baffle chamber and an inlet manifold; and the decompression port is fluidly connected to the baffle chamber of the port cover, and the baffle chamber is fluidly connected to the inlet fluid passage of the port plate;

wherein a pressurized fluid from a compressed piston bore is directed through the decompression port and into the baffle chamber of the port cover and from the baffle chamber through the inlet fluid passage of the port plate and into a low pressure piston bore adjacent to the compressed piston bore.

3. A pump assembly comprising:

a piston rotating group including a pump barrel defining a plurality of bores, and a plurality of moveable pistons that are received in the plurality of bores of the pump barrel;

an input shaft for driving rotation of the piston rotating group;

wherein as the piston rotating group rotates, the pistons extend and contract to drive fluid into and out from the pump assembly;

a port plate having an inlet fluid passage, an outlet fluid passage, and a decompression port;

a port cover including a baffle chamber and an inlet manifold;

the piston rotating group having a position in which a compressed piston bore is fluidly connected to the decompression port of the port plate, the decompression port is fluidly connected to the baffle chamber of the port cover, the baffle chamber is fluidly connected to the inlet fluid passage of the port plate, and the inlet fluid passage of the port plate is fluidly connected to a low pressure piston bore adjacent to the first compressed piston bore, the low pressure piston bore also being fluidly connected to the inlet manifold;

wherein a pressurized fluid from the compressed piston bore is directed through the decompression port of the port plate and into the baffle chamber and from the baffle chamber through the inlet fluid passage of the port plate and into the low pressure piston bore adjacent to the compressed piston bore.

4. The pump assembly of claim 3, wherein the baffle chamber is formed in the port cover separate from the inlet manifold.

5. The pump assembly of claim 3, wherein the baffle chamber is formed by a metal plate inserted transversely across a portion of the inlet manifold.

6. The pump assembly of claim 3, wherein the baffle chamber is machined into the port cover.

7. The pump assembly of claim 3, wherein the baffle chamber is cast into the port cover.

8. The pump assembly as in claim 3, further comprising a displaceable swashplate.

9. The pump assembly as in claim 3, wherein the pump assembly is an axial piston pump assembly.

10. The pump assembly as in claim 3, wherein the pump assembly is a bent axis piston pump assembly.

11. The pump assembly of claim 3, wherein the baffle chamber is part of the inlet manifold of the port cover.

12. The pump assembly of claim 3, wherein the baffle chamber is adjacent the inlet manifold of the port cover.

* * * * *